US007361066B2

(12) United States Patent
Nakamura et al.

(10) Patent No.: US 7,361,066 B2
(45) Date of Patent: Apr. 22, 2008

(54) TERMINAL FITTING AND A BLANK THEREFOR

(75) Inventors: Keiichi Nakamura, Yokkaichi (JP); Ryotaro Ishikawa, Yokkaichi (JP); Yutaka Noro, Yokkaichi (JP); Yutaka Kobayashi, Yokkaichi (JP); Hajime Kawase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/344,649

(22) Filed: Feb. 1, 2006

(65) Prior Publication Data

US 2006/0172622 A1 Aug. 3, 2006

(30) Foreign Application Priority Data

Feb. 2, 2005 (JP) ..... 2005-026667

(51) Int. Cl.
*H01R 4/18* (2006.01)

(52) U.S. Cl. ..... 439/866

(58) Field of Classification Search ..... 439/866, 439/884, 879, 850, 948, 842, 843, 852, 752, 439/849, 877, 858
See application file for complete search history.

(56) References Cited

U.S. PATENT DOCUMENTS

| | | | | |
|---|---|---|---|---|
| 5,649,842 | A | 7/1997 | Ohsumi | |
| 6,659,814 | B2 * | 12/2003 | Kojima | 439/884 |
| 6,666,733 | B2 * | 12/2003 | Takatsuki et al. | 439/884 |
| 6,666,734 | B2 | 12/2003 | Fukatsu | |
| 6,790,105 | B2 | 9/2004 | Fukatsu et al. | |
| 6,790,106 | B2 * | 9/2004 | Ito et al. | 439/884 |
| 6,866,551 | B2 * | 3/2005 | Murakami et al. | 439/884 |
| 2003/0199211 | A1 * | 10/2003 | Fukatsu et al. | 439/884 |
| 2003/0220024 | A1 * | 11/2003 | Tsuji | 439/752 |

* cited by examiner

*Primary Examiner*—Edwin A. Leon
(74) *Attorney, Agent, or Firm*—Gerald E. Hespos; Anthony J. Casella

(57) ABSTRACT

A male terminal fitting (1) is formed by bending a flat metal plate worked into a specified shape and includes a contact (2), a rectangular tube (4) formed to be wider than the contact (2), and a link (3) between the contact (2) and the rectangular tube (4). The link (3) is not connected with the front edge of the upper surface of the rectangular tube (4) over the entire width. Thus, bending resistance against an external force can be improved by increasing deflectability while holding down bending rigidity.

12 Claims, 10 Drawing Sheets

TERMINAL FITTING AND A BLANK THEREFOR

BACKGROUND OF THE INVENTION

1. Field of the Invention

The invention relates to a male terminal fitting and a blank therefor.

2. Description of the Related Art

U.S. Pat. No. 5,649,842 and FIG. 9 herein disclose a male terminal fitting. With reference to FIG. 9, the male terminal fitting is identified generally the numeral 100 and has a terminal contact portion 101 for connection with a female terminal fitting. A link 102 is rearward of the terminal contact portion 101 and a rectangular tube 103 extends rearward from the link 102. A barrel 104 is at the rear end of the male terminal fitting 100 and is configured for connection with a wire W (not shown).

An external force can act on the terminal contact portion 101 and can concentrate stress on a boundary between the link 102 and the terminal contact portion 102, thereby causing a bend beyond a resiliency limit at this boundary.

The present invention was developed in view of this problem and an object thereof is to increase the bending resistance of a male terminal fitting.

SUMMARY OF THE INVENTION

The invention relates to a male terminal fitting with opposite front and rear ends. A contact is disposed at the front end and is configured for contact with a female terminal fitting. A tube is behind the contact and is wider than the contact. A link is provided between the tube and the contact and gradually widens from the contact toward the tube. The link includes a base wall, first and second side walls that extend from the base wall and a ceiling that extends from one of the first side wall. The base wall, the side walls and the ceiling are substantially continuous with the contact and the tube. However, the ceiling of the link does not extend the full width of the tube, and an unconnected edge extends across part of the front of the tube. Accordingly, bending rigidity is lower as compared to a case where the ceiling and the tube are connected over the entire width of the tube. Thus, the contact and of the link are more deflectable in response to external forces on the contact.

The tube preferably includes an engaging portion that is engageable with a lock formed in a cavity of a connector housing when the male terminal fitting is accommodated into the cavity.

The ceiling preferably is bent from the first side wall towards the second side wall or the base wall.

The ceiling preferably has substantially the same width as the contact, and the rear of the ceiling is connected with part of the front of an upper wall of the tube.

An opening preferably is defined adjacent to the unconnected edge, and the male terminal fitting is formed with a closing plate for at least partly closing the opening. Accordingly, external matter or the like cannot intrude into the link or the rectangular tube.

The contact preferably is formed from two or more plates folded to be placed at least partly on one another.

The invention also relates to a blank for forming a male terminal fitting. The blank has an area for forming a contact for contacting a female terminal fitting, an area for forming a tube behind the contact and wider than the contact, and an area for forming a link between the tube and the contact and gradually widened from the contact towards the tube. The area for the link has a base panel continuous with the contact and the tube, side panels continuous with the contact portion and the tube and extending from opposite sides of the base panel, and a ceiling panel substantially continuous with the contact and the tube. An unconnected edge is formed at the front of the tube and is unconnected with the ceiling panel.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 4:
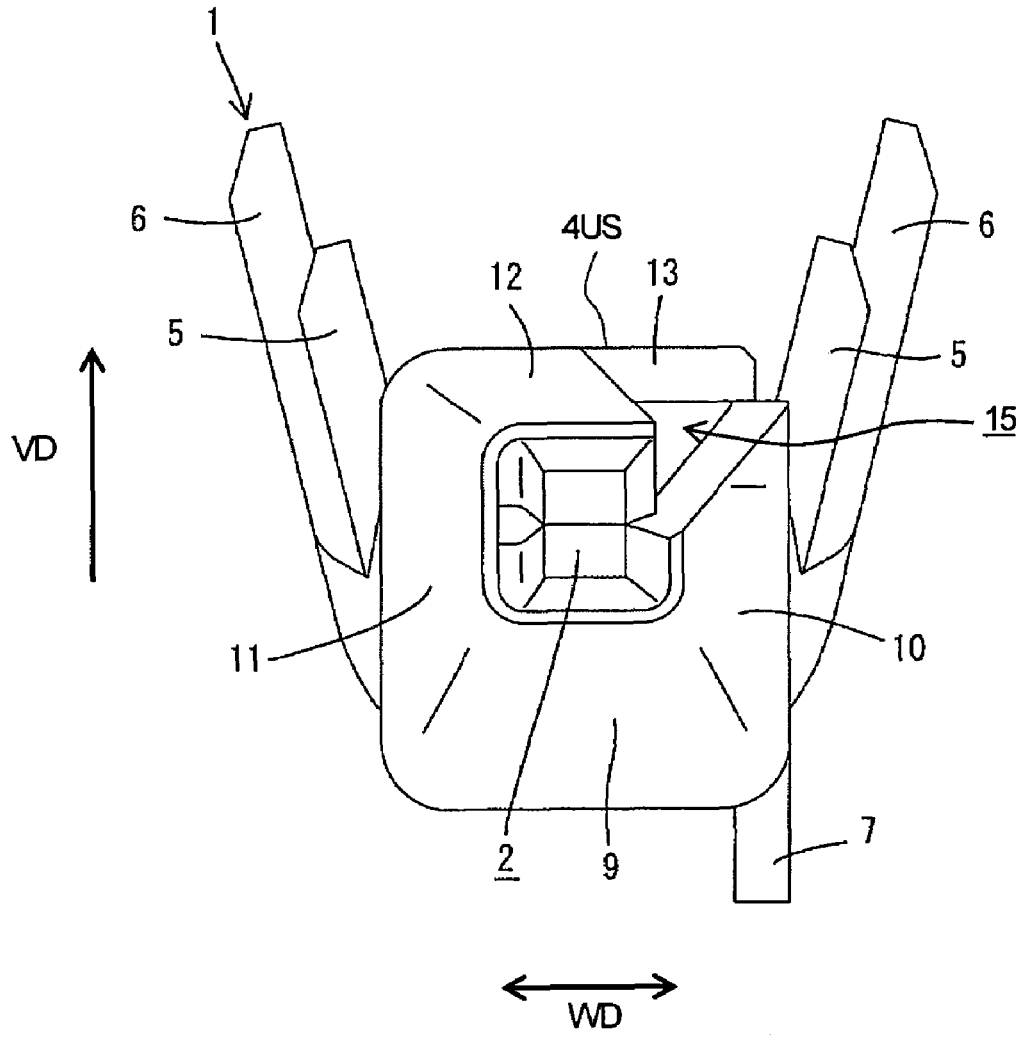
FIG. 4 is a front view of the male terminal fitting.
Figure 5:
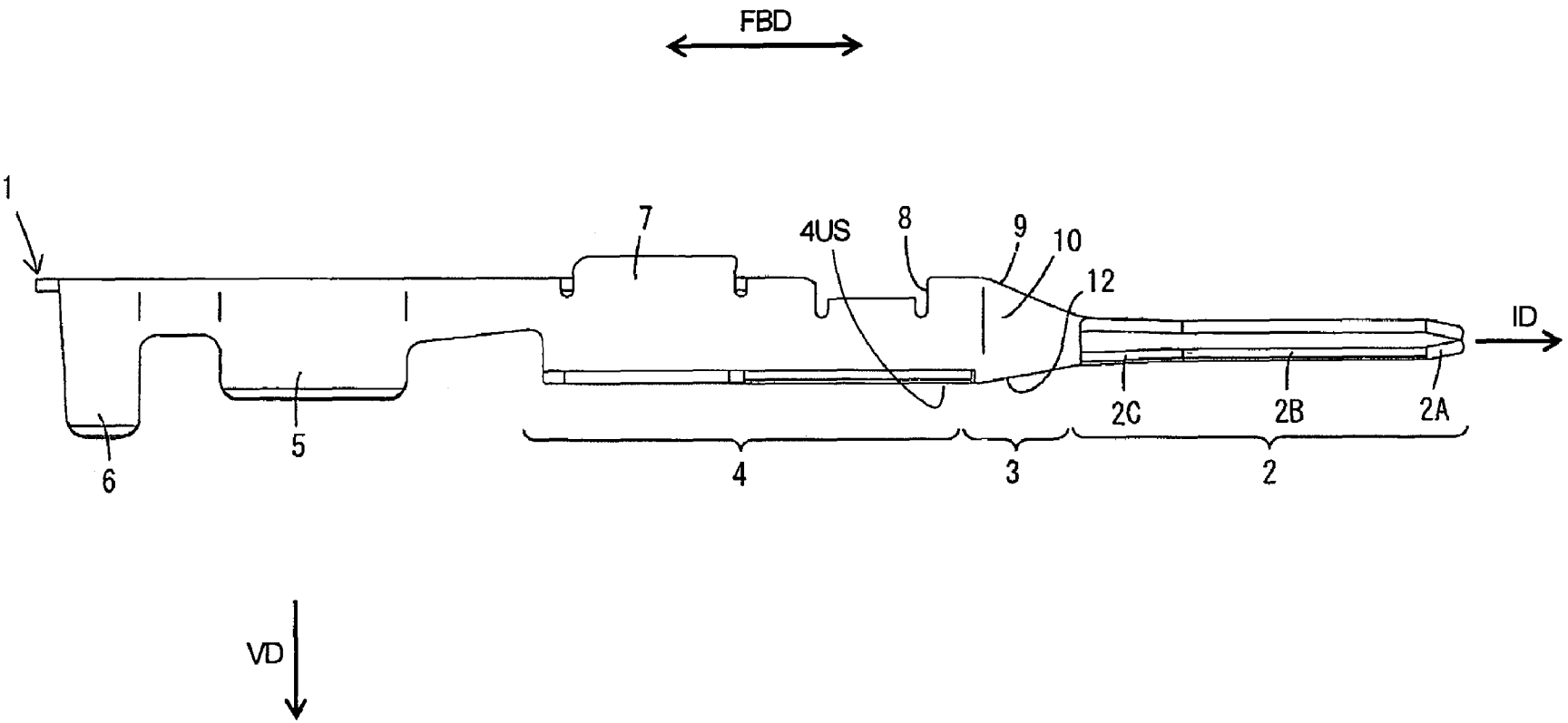
FIG. 5 is a right side view of a male terminal fitting according to a second embodiment.
Figure 6:
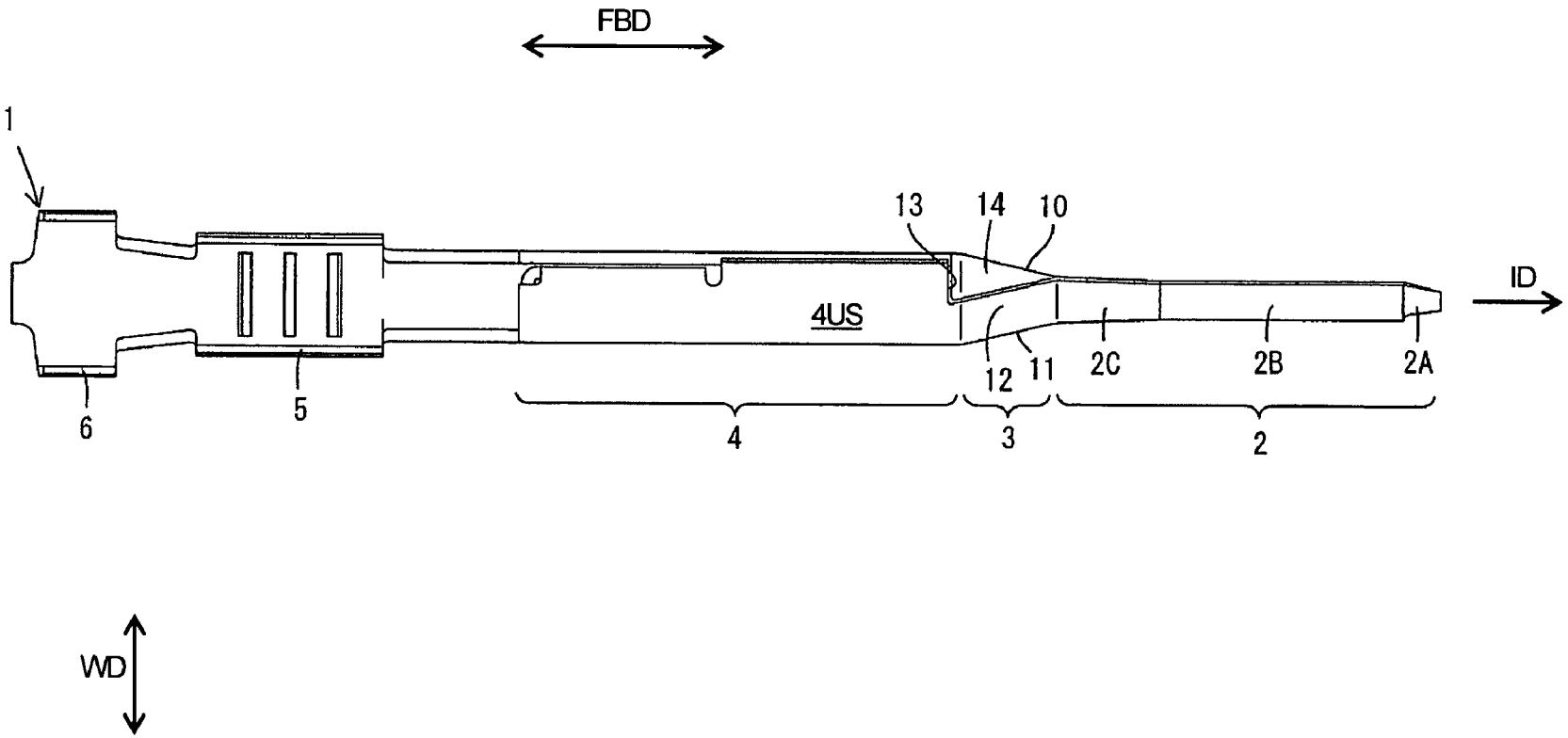
FIG. 6 is a plan view of the male terminal fitting of FIG. 5.
Figure 7:
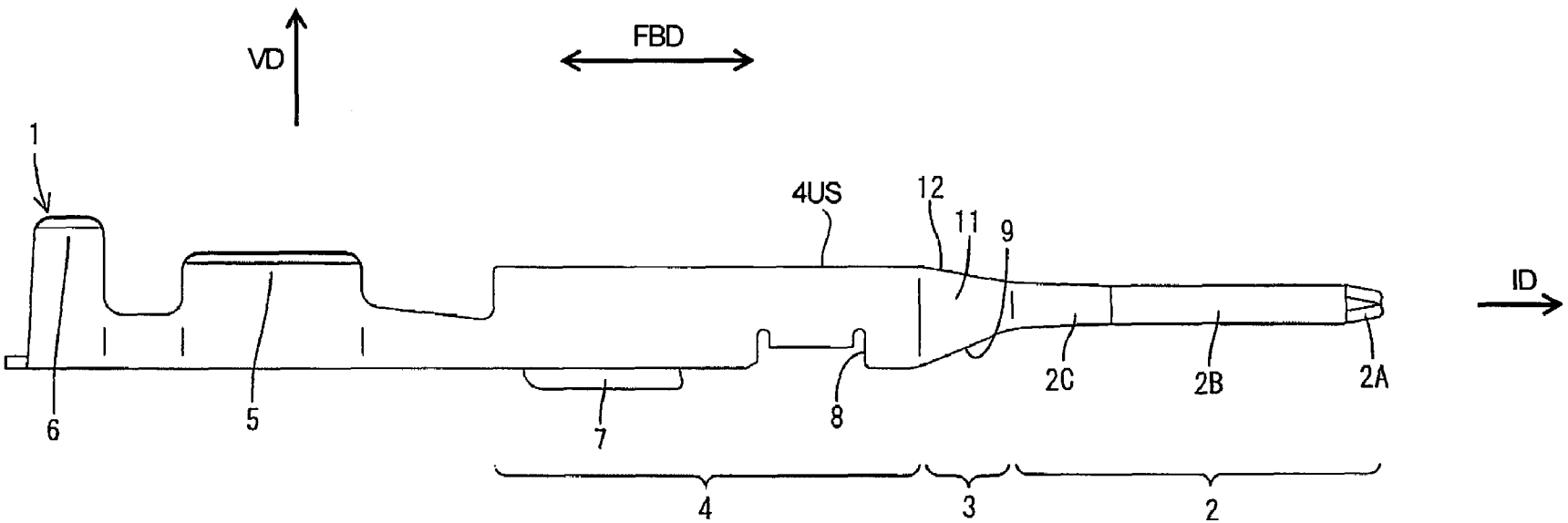
FIG. 7 is a left side view of the male terminal fitting of FIG. 5.
Figure 8:
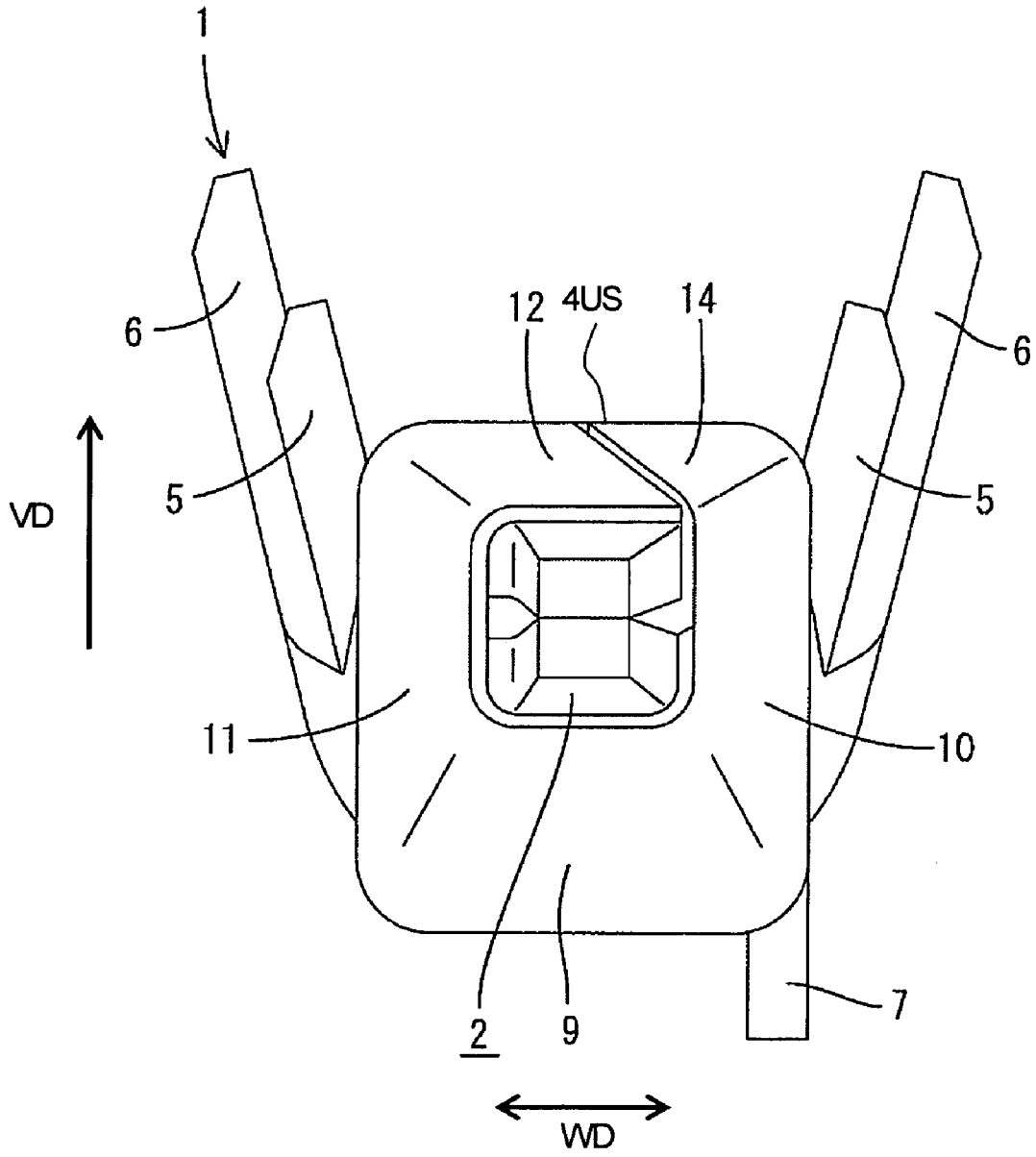
FIG. 8 is a front view of the male terminal fitting of FIG. 5.
Figure 9:
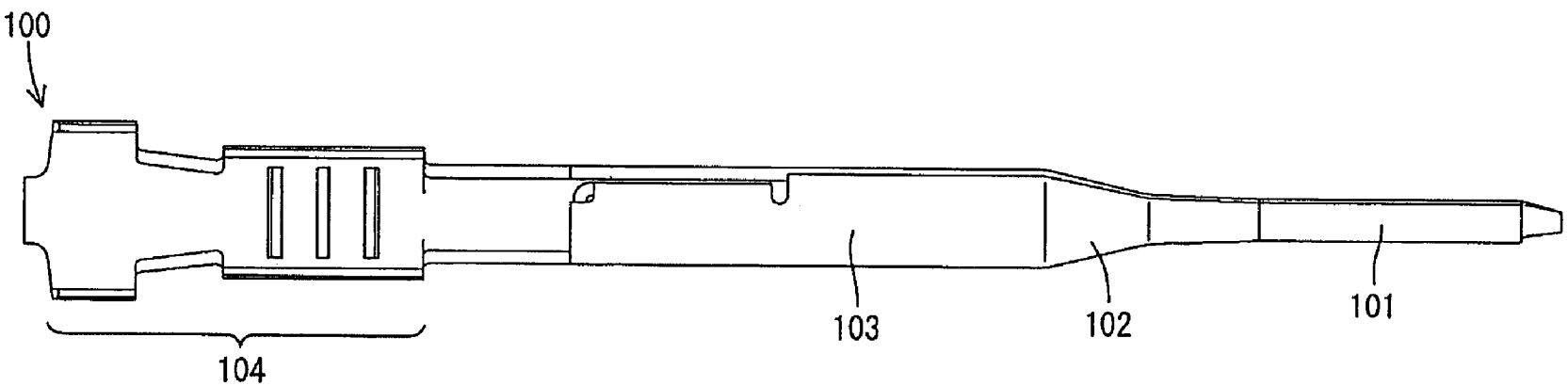
FIG. 9 PRIOR ART
FIG. 9 is a plan view of a male terminal fitting of prior art.

A male terminal fitting according to the invention is identified by the numeral 1 in the figures. The vertical direction VD described herein refers to the vertical orientation in FIG. 4, which is the direction in which the wire barrels 5 and 6 open. The width direction WD described herein refers to the transverse direction in FIG. 4, and the forward and backward directions FBD refer to a direction orthogonal to the plane of FIG. 4. A side of the male terminal fitting 1 that connects with a female terminal is referred to as the front.

The male terminal fitting 1 of the first embodiment is formed by bending a substantially flat conductive metal plate 1PM of a specified shape. The male terminal fitting 1 has an insulation barrel 6 that can be crimped, bent or folded into connection with an insulation coating of a wire W and a wire barrel 5 that can be crimped, bent or folded into connection with a conductive core exposed from the insulation coating. A substantially rectangular tube 4 is formed in an intermediate position of the male terminal fitting 1, and a contact 2 projects forward of the rectangular tube 4 via a link 3. Thus, the male terminal fitting 1 is substantially long along forward and backward directions FBD, and can be accommodated into a cavity of a connector housing (not shown).

Figure 1:
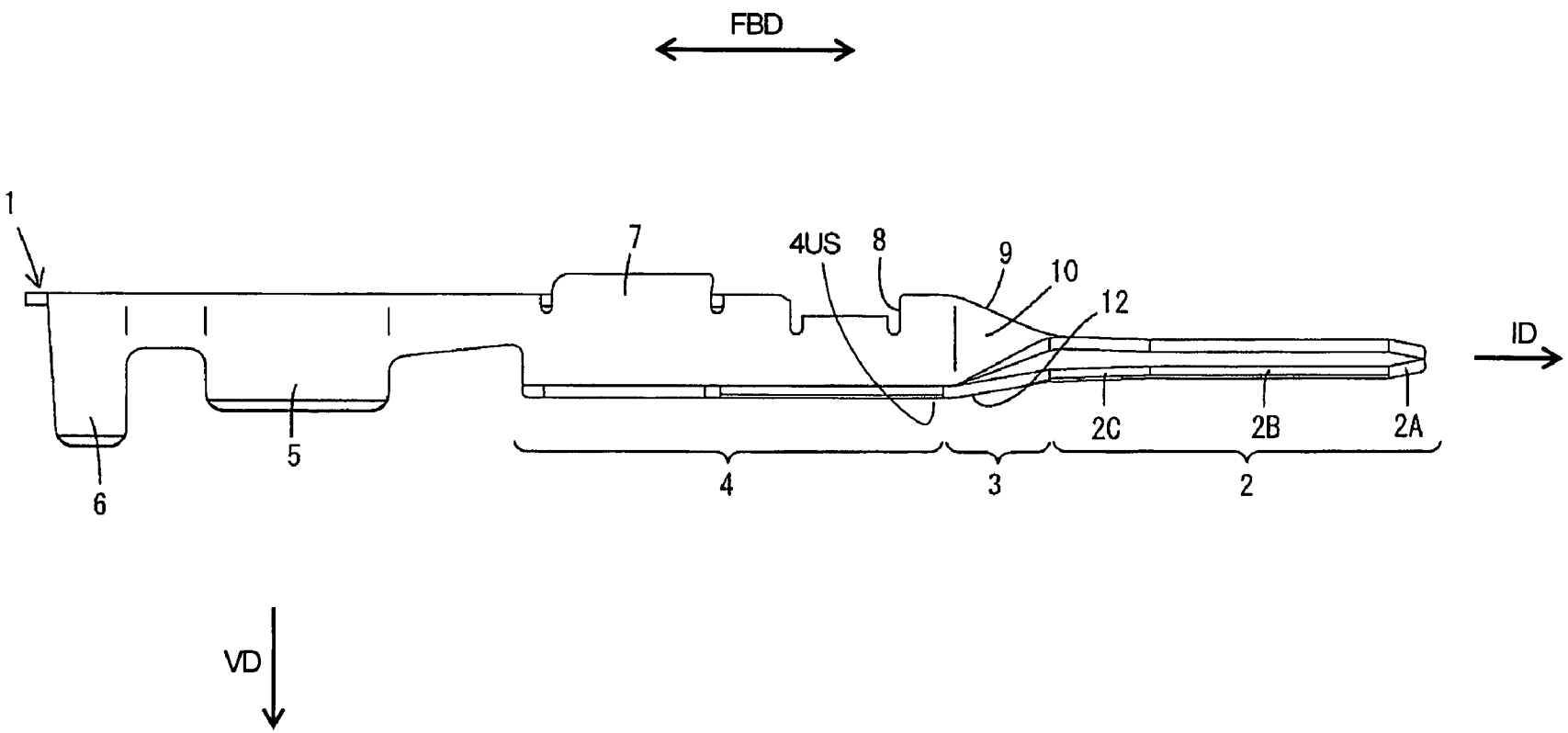
FIG. 1 is a right side view of a male terminal fitting according to a first embodiment.
Figure 2:
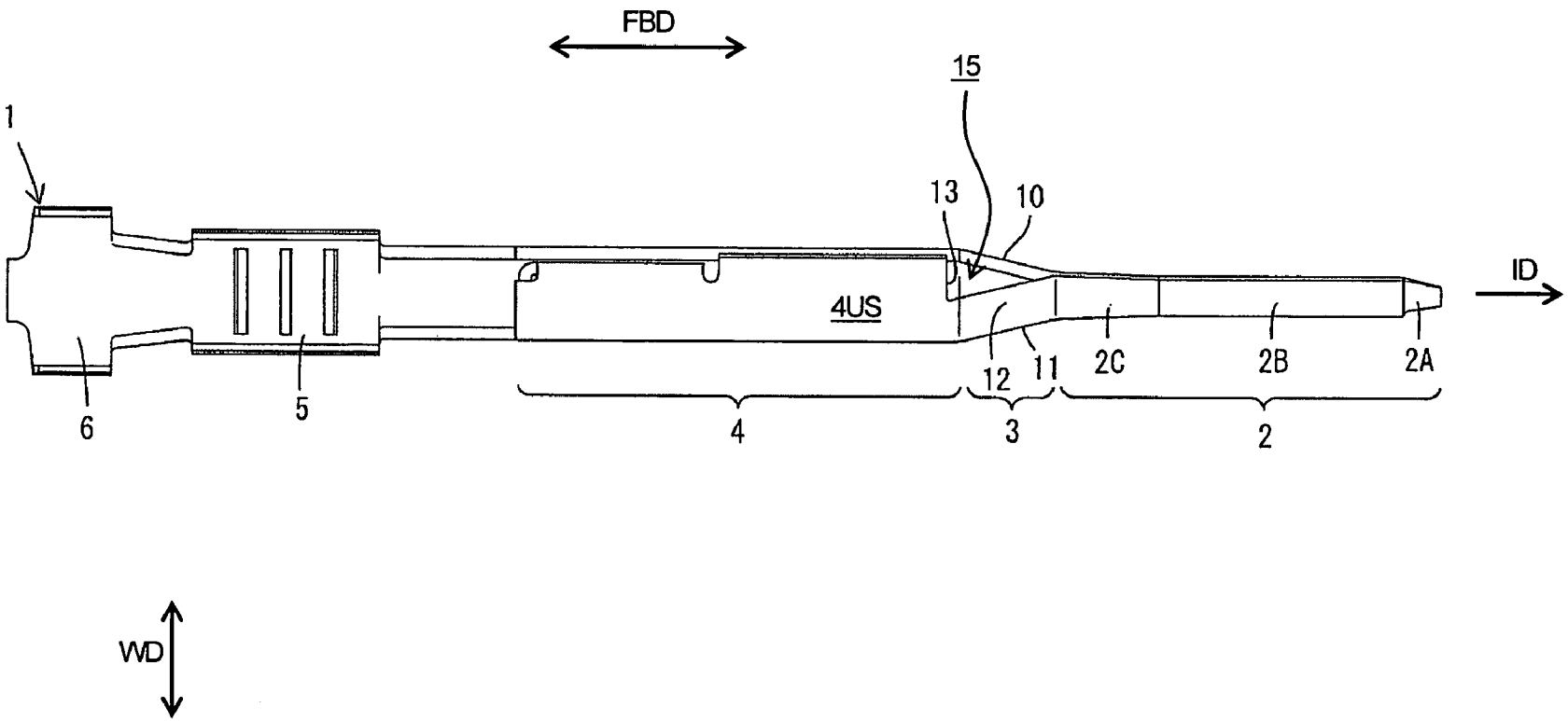
FIG. 2 is a plan view of the male terminal fitting.
Figure 3:
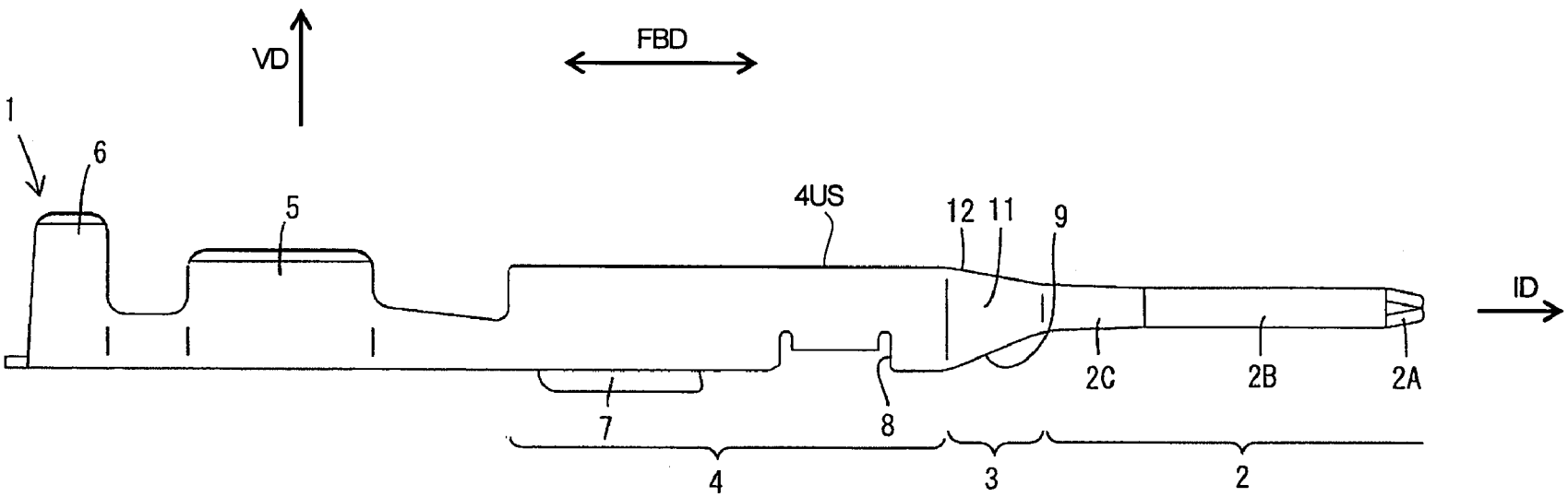
FIG. 3 is a left side view of the male terminal fitting.

As shown in FIG. 1, an engaging portion 8 is formed at a front portion of the rectangular tube 4 and is engageable with a lock (not shown) provided in the cavity. Front and rear grooves are formed in an outer surface of the rectangular tube 4 to extend over substantially the entire width, and an area between the grooves is displaced inwardly to form a recess. The engaging portion 8 is the front one of these steps with respect to an inserting direction ID of the terminal fitting into the housing. A stabilizer 7 is provided at a rear portion of the rectangular tube 4 and is insertable into a guide groove (not shown) in the cavity The stabilizer 7 preferably is formed by making a cut in part of the bottom wall of the rectangular tube 4 and bending the cut portion. The stabilizer 7 can prevent an erroneous insertion such as an upside-down insertion of the male terminal fitting 1 in the cavity.

Figure 10:
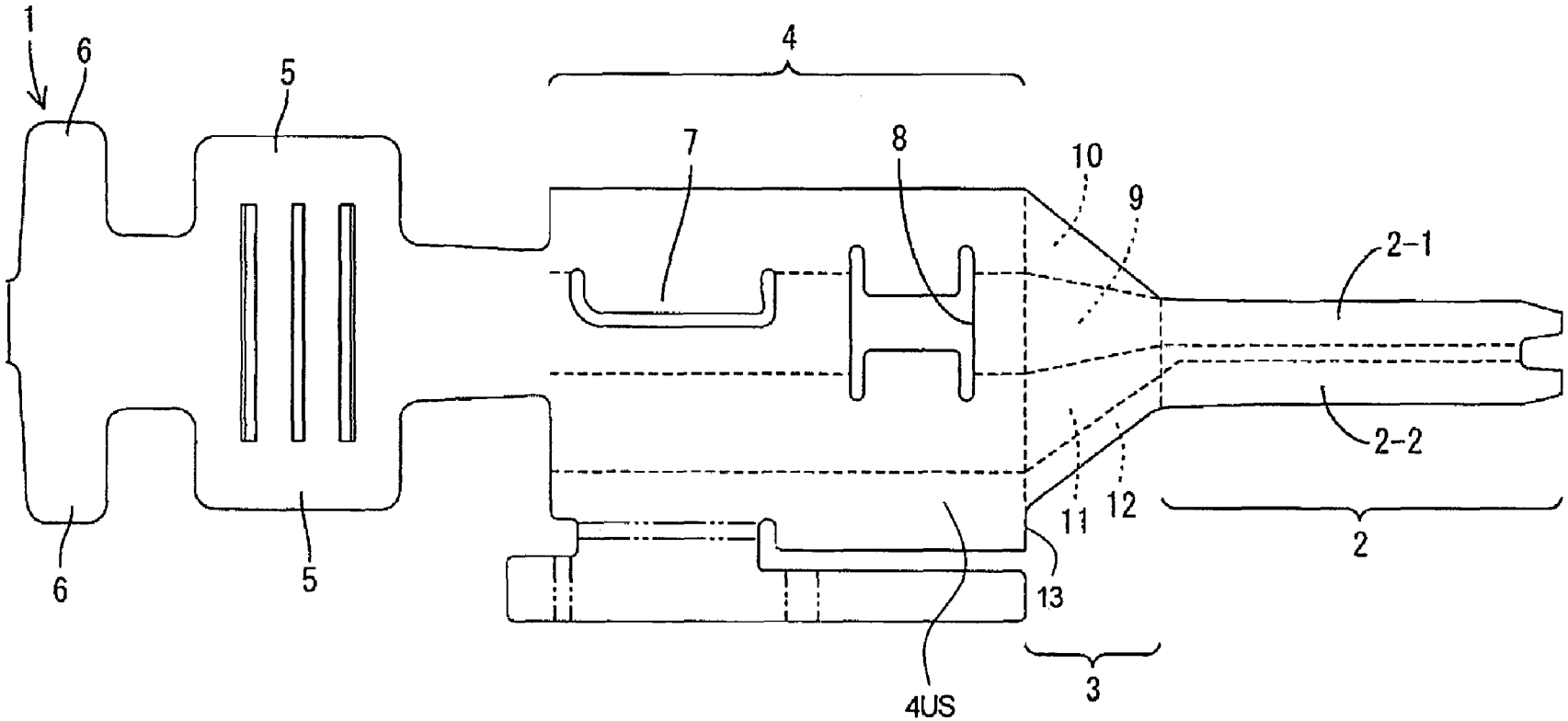
FIG. 10 is a development of the male terminal fitting according to the invention.

As shown in FIG. 10, the contact 2 has a lower plate 2-1 located substantially as an extension of the bottom surfaces of the barrels 5, 6 and an upper plate 2-2 substantially continuous with one lateral edge of the lower plate 2-1. The upper plate 2-2 is bent along a bending line shown in broken line in FIG. 10 and is placed on the lower plate 2-1 to form the contact 2. An introducing portion 2A is at the leading end of the contact and has closely held upper and lower parts. A principal portion 2B is substantially continuous with and behind the introducing portion 2A and defines a clearance of a uniform height between upper and lower plates. An inclined portion 2C is substantially continuous with and behind the principal portion 2B while defining a similar clearance and moderately slopes up and out towards the tube 4. As is clear from the drawings, the width and the vertical dimension of the contact 2 are smaller than the width and vertical dimension of the rectangular tube 4.

The link 3 includes a bottom wall 9 that extends substantially continuously from the lower plate 2-1 of the contact 2 and extending towards the rectangular tube 4. The bottom wall 9 has opposite first and second sides that gradually diverge from one another at locations closer to the rectangular tube 4. Thus, the bottom wall 9 is widened gradually towards the rectangular tube 4. First and second side walls 10, 11 extend up from the first and second opposite side edges of the bottom wall 9 and gradually widen to be continuous with the respective first and second side walls of the rectangular tube 4 at the front end of the rectangular tube 4. A ceiling wall 12 extends from the top of the first side wall 11 and hence is opposed to the bottom wall 9 of the link 3. The ceiling wall 12 has a front end that is continuous with the upper plate 2-2 and a rear end that is continuous with an upper wall 4US of the rectangular tube 4. Additionally, the ceiling wall 12 is aligned at an acute angle to the forward and backward directions FBD and hence at an acute angle to the longitudinal axis of the terminal fitting. Significantly, the ceiling wall 12 has a uniform width that is less than the maximum widths of the bottom wall 9 and the first and second side walls 10 and 11 at locations adjacent the rectangular tube 4. More particularly, the width of the rear end of the ceiling wall 12 is about half the width of the front end of the upper wall 4US of the rectangular tube 4. Thus, an unconnected edge 13 is defined at the front of the upper wall 4US of the rectangular tube 4. The unconnected edge 13 is adjacent to, but unconnected with the ceiling wall 12 of the link 3. Therefore, an opening 15 is formed in the link 3 by the unconnected edge 13, a side edge of the ceiling wall 12 and the upper edge of the second side wall 10.

The ceiling wall 12 of the link 3 is connected with only part of the front end of the upper wall 4US of the rectangular tube 4 to define the unconnected edge 13. Thus, the bending rigidity of the contact 2 is reduced, as compared to a case where the ceiling wall 12 is connected with the front end of the upper wall 4US of the rectangular tube 4 over the entire width without forming the unconnected edge 13, thereby improving the deflectability or bendability of the contact 2. Therefore, external forces on the contact 2 are not likely to produce a crack or the like due to the concentration of a stress and a deformation of the contact 2 resulting in a bend can be suppressed.

A second embodiment of the invention is described with reference to FIGS. 5 to 8. In the second embodiment, a closing plate 14 closes the opening 15 formed in the link 3 of the first embodiment is closed. The other construction is the same as or similar to the first embodiment. These similar parts are identified by the same reference numerals in FIGS. 5 to 8, but are not described again.

The closing plate 14 has a shape that substantially conforms to the shape of the opening 15 and is substantially continuous with the upper edge of the second side wall of the link 3 that is not connected with the ceiling wall 12. It should be noted that the second embodiment is the same as the first embodiment in that the front edge of the upper wall 4US of the rectangular tube 4 has the unconnected edge irrespective of whether the front edge is coupled to the closing plate 14.

As described above, the closing plate 14 of the second preferred embodiment, prevents external matter or the like from intruding into the link 3 or the rectangular tube 4 in addition to the effects of the first embodiment since no opening is left in the ceiling wall 12 of the link 3.

The invention is not limited to the above described and illustrated embodiments. For example, the following embodiment is also embraced by the technical scope of the present invention as defined by the claims. Beside the following embodiment, various changes can be made without departing from the scope and spirit of the present invention as defined by the claims.

The unconnected edge 13 is at a front of the upper wall of the rectangular tube 4 in the first and second embodiments. However, the unconnected edge 13 may be formed over substantially the entire width of the front edge of the upper wall of the rectangular tube 4.

The tube of the preferred embodiments has a substantially rectangular cross-section. However, the invention is equally applicable to tubes having other shapes, particularly substantially polygonal shapes (triangular, pentagonal, hexagonal, etc.).

The terminal fitting described above is connected to the wire by barrels. However, other means of connection may be used such as insulation displacement, soldering, (ultrasonic) welding, etc.

What is claimed is:

1. A male terminal fitting, comprising:

a contact to be brought into contact with a female terminal fitting, a substantially rectangular tube located behind the contact with respect to a longitudinal direction of the terminal fitting, the tube including a tube base wall, a tube ceiling wall opposed to the tube base wall and first and second tube side walls extending between the tube base wall and the tube ceiling wall to define a width for the tube that is wider than the contact, and a link provided between the tube and the contact and gradually widened from the contact toward the tube, wherein:

the link includes a link base wall substantially continuous with the contact and the tube base wall, first and second link side walls substantially continuous with the first and second tube side walls respectively and standing from the link base wall, and a unitary link ceiling wall substantially continuous with the contact and the first link side wall, the link ceiling wall being unconnected with the second link side wall and unconnected with a portion of the tube ceiling wall, and an unconnected edge formed at a front end of the tube, the unconnected edge being rearward of the link and being unconnected with the link ceiling wall.

2. The male terminal fitting of claim 1, wherein the tube includes an engaging portion engageable with a lock formed in a cavity of a connector housing when the male terminal fitting is accommodated into the cavity.

3. The male terminal fitting of claim 1, wherein the contact is formed from two plates folded onto one another, each of the plates having an edge, and the edges being substantially registered with one another.

4. The male terminal fitting of claim 1, wherein the ceiling wall and the contact have substantially equal widths, and a rear end of the ceiling wall is connected with a front part of the tube substantially adjacent the unconnected edge the width of the ceiling wall being substantially constant at all locations between the contact and the tube.

5. The male terminal fitting of claim 4, wherein an opening is defined adjacent to the unconnected edge, and the male terminal fitting is formed with a closing plate for at least partly closing the opening, the closing plate being unconnected to the tube.

6. The male terminal fitting of claim 1, wherein the link ceiling wall and the tube ceiling wall define outwardly facing surfaces on the male terminal fitting.

7. The male terminal fitting of claim 6, wherein at least a portion of the unconnected edge extends substantially linearly in a width direction.

8. The male terminal fitting of claim 7, wherein the width ceiling wall is no wider than the contact.

9. A male terminal fitting, comprising:

a contact to be brought into contact with a female terminal fitting, a tube located behind the contact and formed to be wider than the contact, and a link provided between the tube and the contact and gradually widened from the contact towards the tube, wherein:

the link includes a base wall substantially continuous with the contact and the tube, first and second side walls substantially continuous with the contact and the tube and standing from opposite sides of the base wall, and a ceiling wall substantially continuous with the contact and with the first side wall, the ceiling wall extending rearwardly from the contact towards the tube and towards the second side wall, the ceiling wall having a substantially uniform width at all locations thereon, and an unconnected edge formed at the front of the tube and being unconnected with the ceiling wall.

10. The male terminal fitting of claim 9, wherein the contact has a rear end joined to the link and a front end forward of the rear end, the contact including a principal portion extending along a major portion of a length of the contact between the front and rear ends, an inclined portion extending from the principal portion to the link, the inclined portion being continuous with and behind the principal portion and sloping moderately up to larger cross-sections towards the link.

11. The male terminal fitting of claim 9, wherein the ceiling wall and the unconnected edge of the tube define external surfaces for the male terminal fitting.

12. The male terminal fitting of claim 11, wherein at least a portion of the unconnected edge extends substantially linearly in a width direction.

* * * * *